US012338639B2

(12) United States Patent
Ponticorvo

(10) Patent No.: US 12,338,639 B2
(45) Date of Patent: Jun. 24, 2025

(54) MODULAR TRIM ASSEMBLY

(71) Applicant: Antonio Ponticorvo, Calgary (CA)

(72) Inventor: Antonio Ponticorvo, Calgary (CA)

(73) Assignee: Antonio Ponticorvo, Calgary (CA)

( * ) Notice: Subject to any disclaimer, the term of this patent is extended or adjusted under 35 U.S.C. 154(b) by 205 days.

(21) Appl. No.: 18/453,512

(22) Filed: Aug. 22, 2023

(65) Prior Publication Data

US 2025/0067063 A1 Feb. 27, 2025

(51) Int. Cl.
*E04F 19/06* (2006.01)

(52) U.S. Cl.
CPC ..... *E04F 19/062* (2013.01)

(58) Field of Classification Search
CPC ..... E04F 19/062; E06B 2003/66395; E06B 2003/6258; E06B 3/5454; E06B 1/342; E06B 3/30; E06B 1/20; E06B 1/34; E06B 1/56; E06B 1/62; E06B 2001/622
USPC ..... 52/58, 60, 62, 204.1, 204.53, 204.71, 52/211, 212, 470
See application file for complete search history.

(56) References Cited

U.S. PATENT DOCUMENTS 646,495 A * 4/1900 Jager ..... E04F 19/062 52/471
2,771,970 A * 11/1956 Geyser ..... E06B 1/56 52/204.5
3,604,155 A * 9/1971 Brown ..... E06B 1/524 49/504
3,757,483 A 9/1973 Torbett
4,040,223 A * 8/1977 Hillstrom ..... E04F 19/065 52/235
4,319,439 A 3/1982 Gussow
4,843,783 A * 7/1989 Taravella ..... E04B 1/944 52/212
5,090,174 A * 2/1992 Fragale ..... E04F 19/061 52/287.1
5,222,343 A * 6/1993 Anderson ..... E04F 19/061 52/717.06
5,560,170 A * 10/1996 Ganser ..... E04F 19/024 52/212
6,122,883 A * 9/2000 Braun ..... E06B 1/62 52/287.1
6,293,072 B1 9/2001 Hodgson
6,526,707 B2 * 3/2003 Tucker ..... E06B 1/62 52/287.1
8,161,708 B2 * 4/2012 Schacht ..... E04F 15/02005 52/312

(Continued)

*Primary Examiner* — Brian E Glessner
*Assistant Examiner* — Adam G Barlow
(74) *Attorney, Agent, or Firm* — Argus Intellectual Enterprise, LLC; Jordan Sworen; Daniel Enea

(57) ABSTRACT

A modular trim assembly for finishing seams around exterior building structures, such as windows and doors. The modular trim assembly includes a U-shaped base unit having a channel formed in a pair of sidewalls extending a length of the base unit. A pair of L-shaped side units slide into each channel and form an underside beneath a building structure. An exterior unit disposed secured to the top surface of the base unit, wherein the exterior unit receives an over trim section that forms the trim disposed around the exterior of the building structure. In an assembled configuration, a gap is formed between the side units and over trim sections, wherein the gap can receive siding or a window frame within the gap.

12 Claims, 5 Drawing Sheets

(56) References Cited

U.S. PATENT DOCUMENTS

| | | | | |
|---|---|---|---|---|
| 8,245,473 | B2 * | 8/2012 | Schacht | E04F 19/063 52/468 |
| 8,490,350 | B1 * | 7/2013 | Greely | E06B 1/34 52/287.1 |
| 9,260,871 | B2 * | 2/2016 | Shaw | E04F 13/24 |
| 9,534,402 | B2 | 1/2017 | Shaw | |
| 9,593,494 | B2 * | 3/2017 | Frenette | E04F 19/063 |
| 10,900,243 | B2 | 1/2021 | Koethe | |
| 2006/0150565 | A1 * | 7/2006 | Schacht | E04F 19/062 52/716.1 |
| 2008/0034696 | A1 * | 2/2008 | Neuhofer | E04F 19/065 52/466 |
| 2009/0266021 | A1 * | 10/2009 | Neuhofer, Jr. | E04F 19/065 52/468 |

* cited by examiner

MODULAR TRIM ASSEMBLY

BACKGROUND OF THE INVENTION

The present invention relates to a system for installing and positioning between and around windows, doors, and the like. More specifically, the present invention provides a modular trim assembly for easy installation and removal around an exterior window or door.

In the realm of interior design and architectural aesthetics, trim assemblies have long served as the finishing touch that elevates the visual appeal of spaces. Traditional trim installations involve intricate carpentry work, often requiring skilled labor and significant time investment. These systems consist of fixed, non-modular components that are permanently affixed to walls, ceilings, and other surfaces, contributing to the overall design scheme. While these traditional trim systems have been effective in enhancing interior spaces, they are accompanied by several limitations that hinder their adaptability and usability.

Traditional trim assemblies suffer from several key deficiencies that have prompted the need for innovation. Fixed trim components are inherently rigid, making it challenging to adapt them to changing design preferences, renovations, or functional requirements. Once installed, alterations or removal can lead to damage and may necessitate significant repair work. The installation process of traditional trim assemblies is labor-intensive and time-consuming. Highly skilled craftsmen are often required, leading to increased costs and longer project timelines. Similarly, the removal or replacement of these components demands considerable effort and may cause disruptions to the space. As a result, non-modular trim assemblies primarily cater to professionals due to their complexity, leaving do-it-yourself enthusiasts with limited options for enhancing their living spaces without professional assistance. Additionally, the permanence of traditional trim installations can contribute to wastage during renovations or design changes, potentially leading to environmental concerns. Therefore, there exists a need in the art for a modular trim assembly that allows for easy installation and removal thereof by having a plurality of pieces that easily secure to one another to form an exterior trim around a door or window.

In light of the devices disclosed in the known art, it is submitted that the present invention substantially diverges in design elements and methods from the known art and consequently it is clear that there is a need in the art for an improvement for a modular trim assembly. In this regard the instant invention substantially fulfills these needs.

SUMMARY OF THE INVENTION

In view of the foregoing disadvantages inherent in the known types of modular trim assemblies now present in the known art. The present invention provides a new modular trim assembly wherein the same can be utilized for easy installation and removal around an exterior window or door.

It is an objective of the present invention to provide a modular trim assembly comprising a U-shaped base unit having a channel formed in a pair of sidewalls extending a length of the base unit. A pair of L-shaped side units slide into each channel and form an underside beneath a building structure. An exterior unit disposed secured to the top surface of the base unit, wherein the exterior unit receives an over trim section that forms the trim disposed around the exterior of the building structure. In an assembled configuration, a gap is formed between the side units and over trim sections, wherein the gap can receive siding or a window frame therebetween.

It is another objective of the present invention to provide a modular trim assembly comprising an interlocking design that allows users to easily customize and adapt their spaces, accommodating changing preferences and functional needs without causing damage or extensive renovations.

It is another objective of the present invention to provide a modular trim assembly that contributes to sustainable design practices by promoting reuse and minimizing waste during renovations. The modular nature of the trim assembly facilitates component disassembly and reusability, aligning with environmentally conscious principles and reducing the environmental impact of interior updates.

It is yet another objective of the present invention to provide a modular trim assembly that offers a cost-effective alternative to traditional trim assemblies. The simplified installation process, reduced labor requirements, and potential for DIY installation translate to lower overall project costs, making interior design enhancements more accessible to a broader range of individuals.

It is therefore an object of the present invention to provide a new and improved modular trim assembly, that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
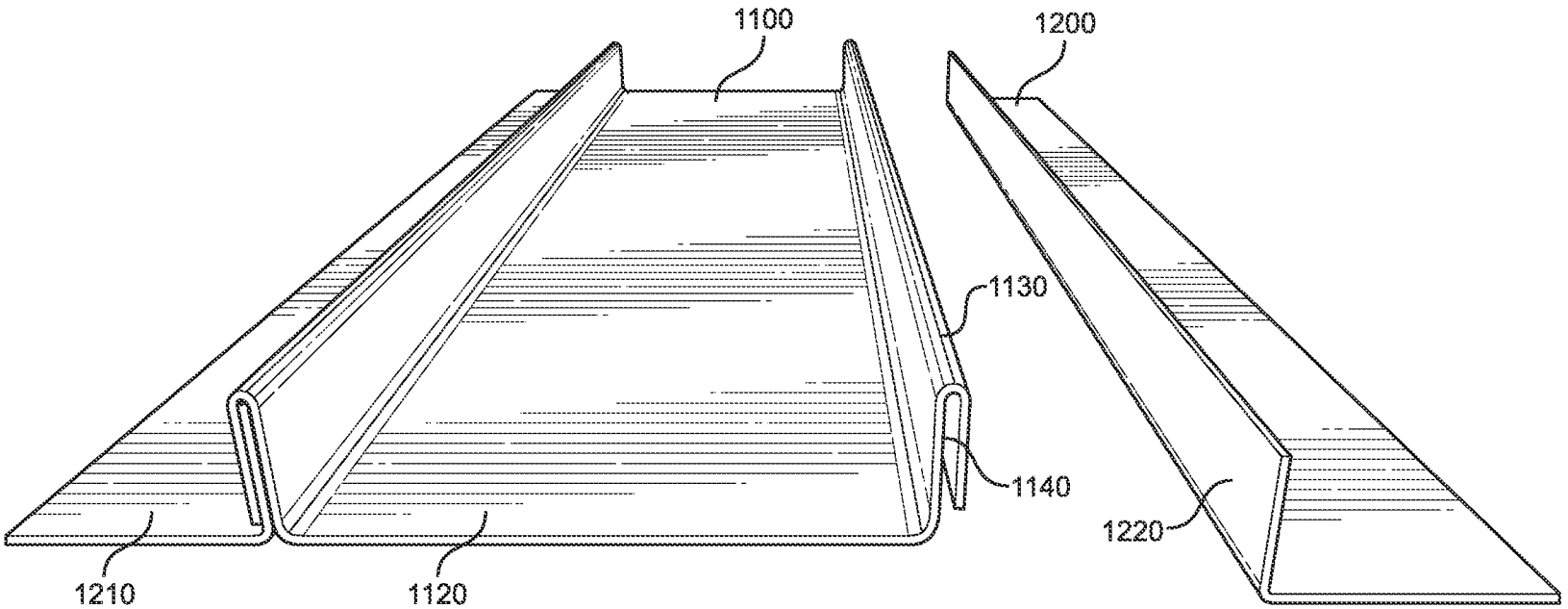
FIG. 1 shows a perspective view of a base unit and side units of an embodiment of the modular trim assembly.

Reference is made herein to the attached drawings. Like reference numerals are used throughout the drawings to depict like or similar elements of the modular trim assembly. For the purpose of presenting a brief and clear description of the present invention, the embodiment discussed will be used for installing trim between exterior siding and a window frame. The figures are intended for representative purposes only and should not be considered to be limiting in any respect. Furthermore, the described features, structures, or characteristics may be combined in any suitable manner in one or more embodiments. In the following description, numerous specific details are provided to give a thorough understanding of embodiments.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Referring now to FIG. 1, there is shown a perspective view of a base unit and side units of an embodiment of the modular trim assembly. The present invention provides a modular trim assembly for easy installation and removal around an exterior structure, such as a window or door. In the illustrated embodiment, the modular trim assembly comprises a plurality of components intended to easily slide or otherwise fit together and form a decorative and functional trim. In the illustrated embodiment, the modular trim assembly comprises a base 1100 unit having a rear wall 1120 and a pair of parallel sidewalls 1130 extending from opposing lateral edges of the rear wall 1120. The rear wall 1120 is flat and configured to rest against an exterior wall. In the illustrated embodiment, the base unit 1100 comprises a rectangular shape. In the illustrated embodiment, A channel 1140 is formed in each of the sidewalls 1130 and extends an entire length of the base unit 1100. In the illustrated embodiment, the channel 1140 is formed via a fold in the respective sidewall 1130, such that a lower end of the channel 1140 is open. However, in alternate embodiments, the channel is formed via any suitable manner.

The modular trim assembly further comprises a pair of side units 1200 configured to secure to the base unit 1100 and form the under trim to the exterior structure. In the illustrated embodiment, each side unit 1200 comprises an L-shape having an under trim section 1210 extending perpendicular to a mounting section 1220. The mounting section 1220 of each of the side unit 1200 is configured to slide into the channels 1140 of the base unit 1100 to secure thereto. In the illustrated embodiment, the under trim section 1210 comprises a greater width than a width of the mounting section 1220, wherein the widths are measured between lateral edges thereof. In the illustrated embodiment, the side unit 1200 comprises a same length as the length of the base unit 1100. However, in alternate embodiments, the lengths differ. In the shown embodiment, the rear wall 1120 of the base unit 1100 is wider than the width of the under trim section 1210 of the side unit 1200. A height of the channel 1140 formed in the sidewall 1130 of the base unit 1100 is slighter greater than the width of the mounting section 1220 such that the under trim section 1210 and the rear wall 1120 can rest flush against the exterior wall of the building when secured to one another. In the shown embodiment, the base unit 1100 and side units 1200 are formed from integral sheets that include folds that form the described structure. The integral sheets and interconnectivity provide an exterior side without exposed joints, thereby making the trim form a waterproof and vapor barrier.

Figure 2:
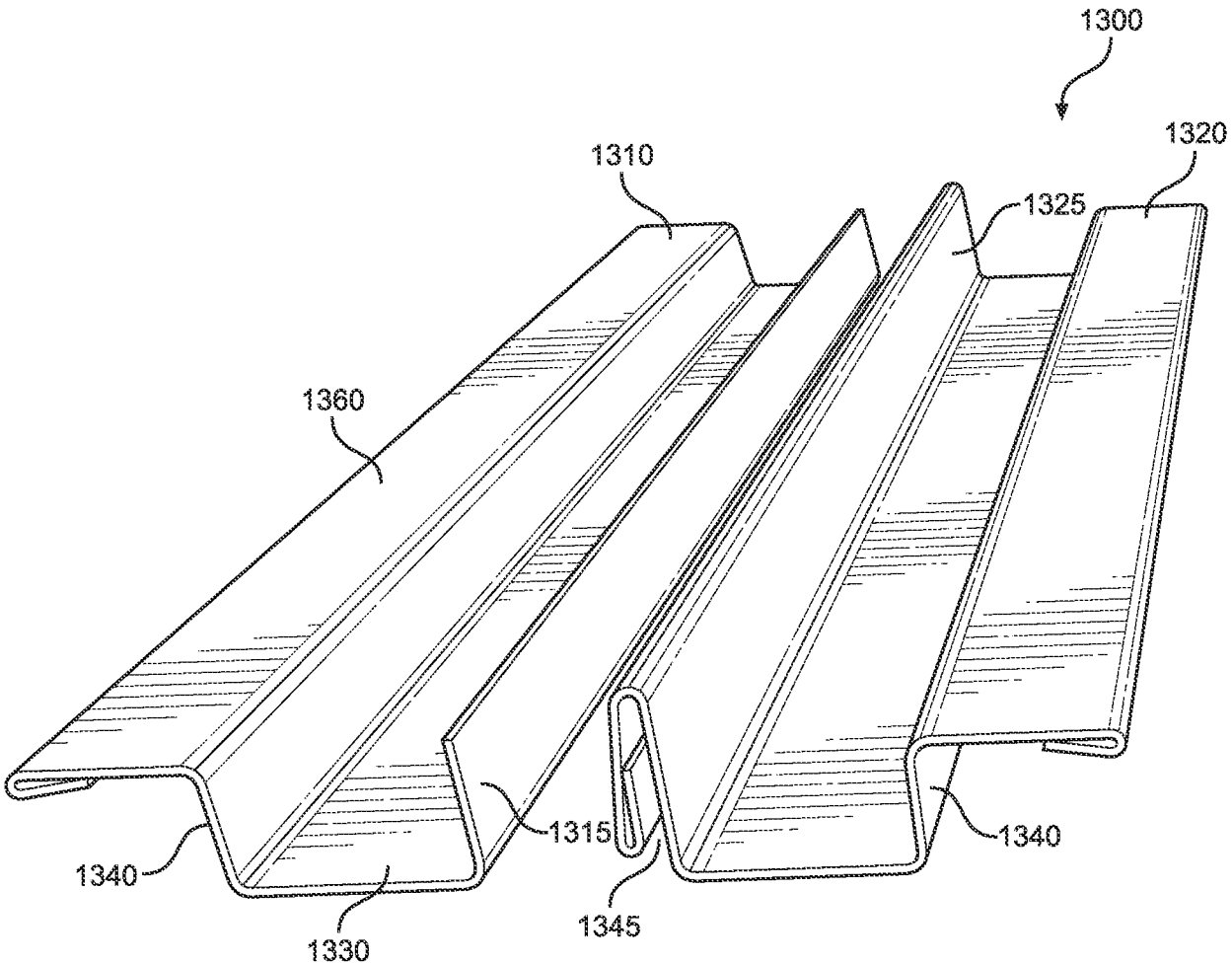
FIG. 2 shows a perspective view of an exterior unit of an embodiment of the modular trim assembly.

Referring now to FIG. 2, there is shown a perspective view of an exterior unit of an embodiment of the modular trim assembly. The modular trim assembly further comprises an exterior unit 1300 the forms the exterior trim of the assembly. In the illustrated embodiment, the exterior unit 1300 is formed from a first exterior member 1310 and a second exterior member 1320 removably securable to one another. Each exterior member 1310, 1320 comprises a rear wall 1330 and an outer sidewall 1340 that form the rear wall and outer sidewall of the exterior unit 1300. The first exterior member 1310 comprises a mounting member 1315 parallel to the outer sidewall 1340 thereof and the second exterior member 1320 comprises an interior sidewall 1325 having a U-shaped channel 1345 extending therethrough. In this way, the mounting member 1315 is slidably securable to the channel 1345.

An over trim section 1360 extends from an upper end of each outer sidewall 1340 to overhang the building structure or siding 6000 that abuts with the assembly. In the illustrated embodiment, the over trim section 1360 is perpendicular to the mounting member 1315 and the channel 1325 of the exterior unit 1300. In the illustrated embodiment, a width of the rear wall 1330 of the first and second exterior member 1310, 1320 are substantially equivalent.

Figure 3:
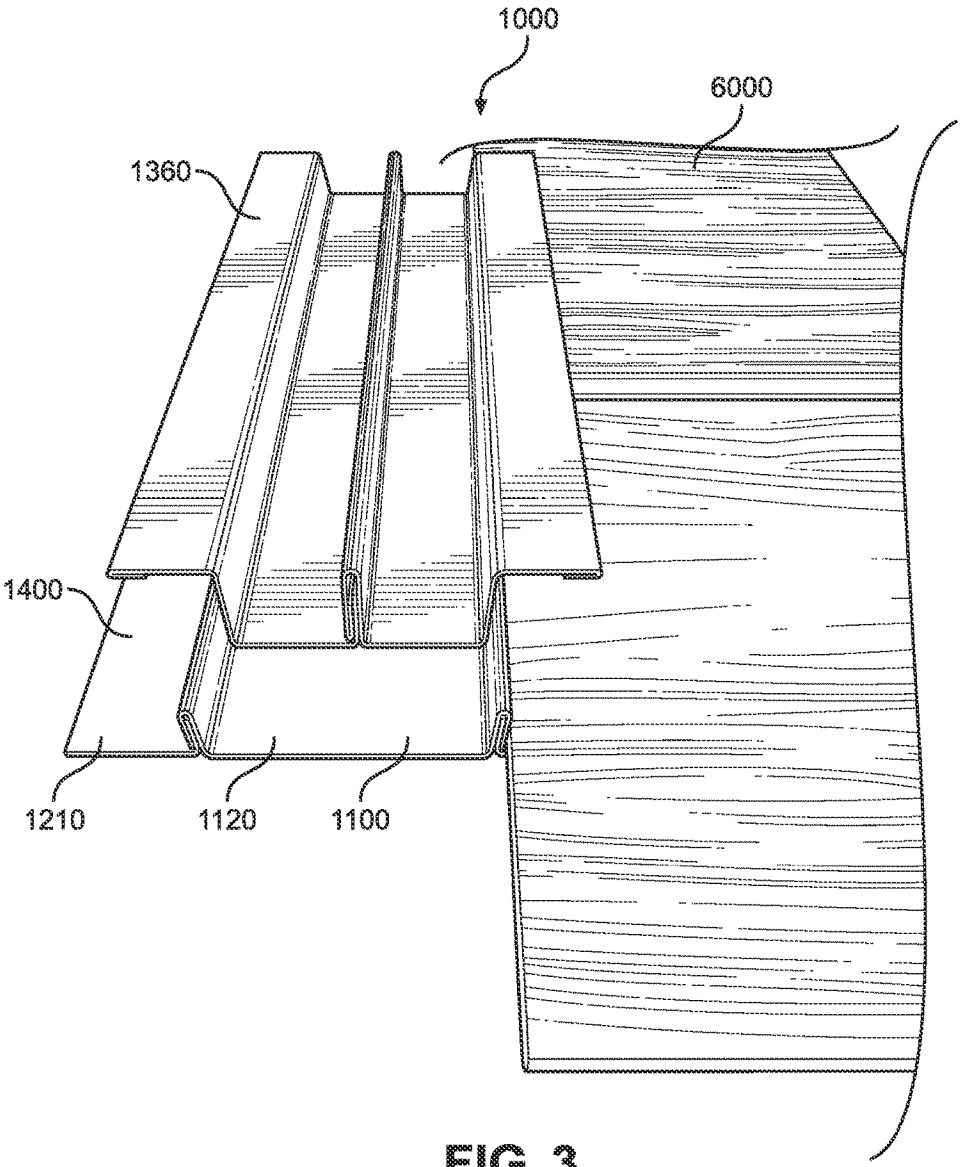
FIG. 3 shows a perspective view of an embodiment of the modular trim assembly in an assembled configuration.
Figure 4:
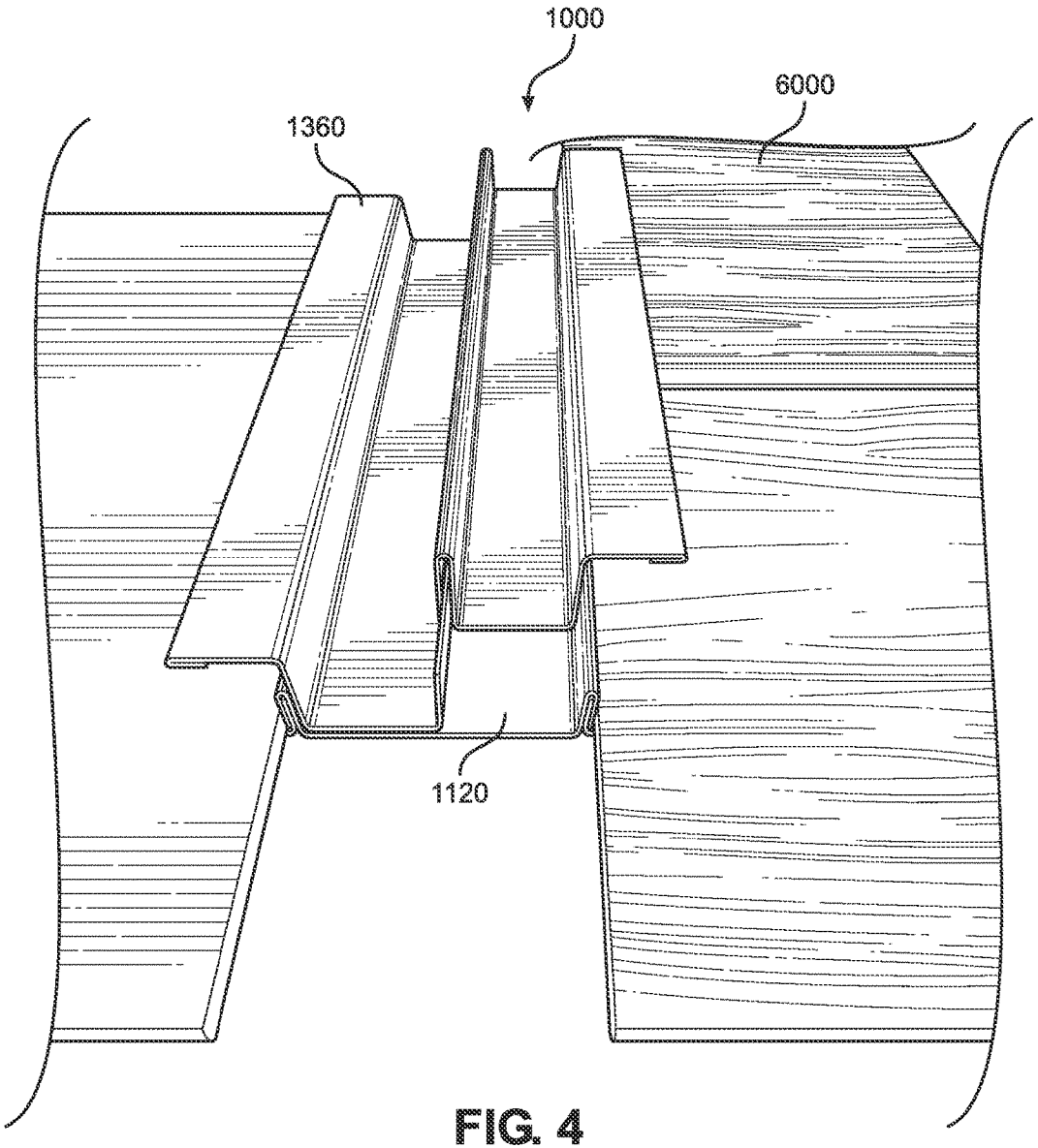
FIG. 4 shows a perspective view of an embodiment of the modular trim assembly in use.
Figure 5:
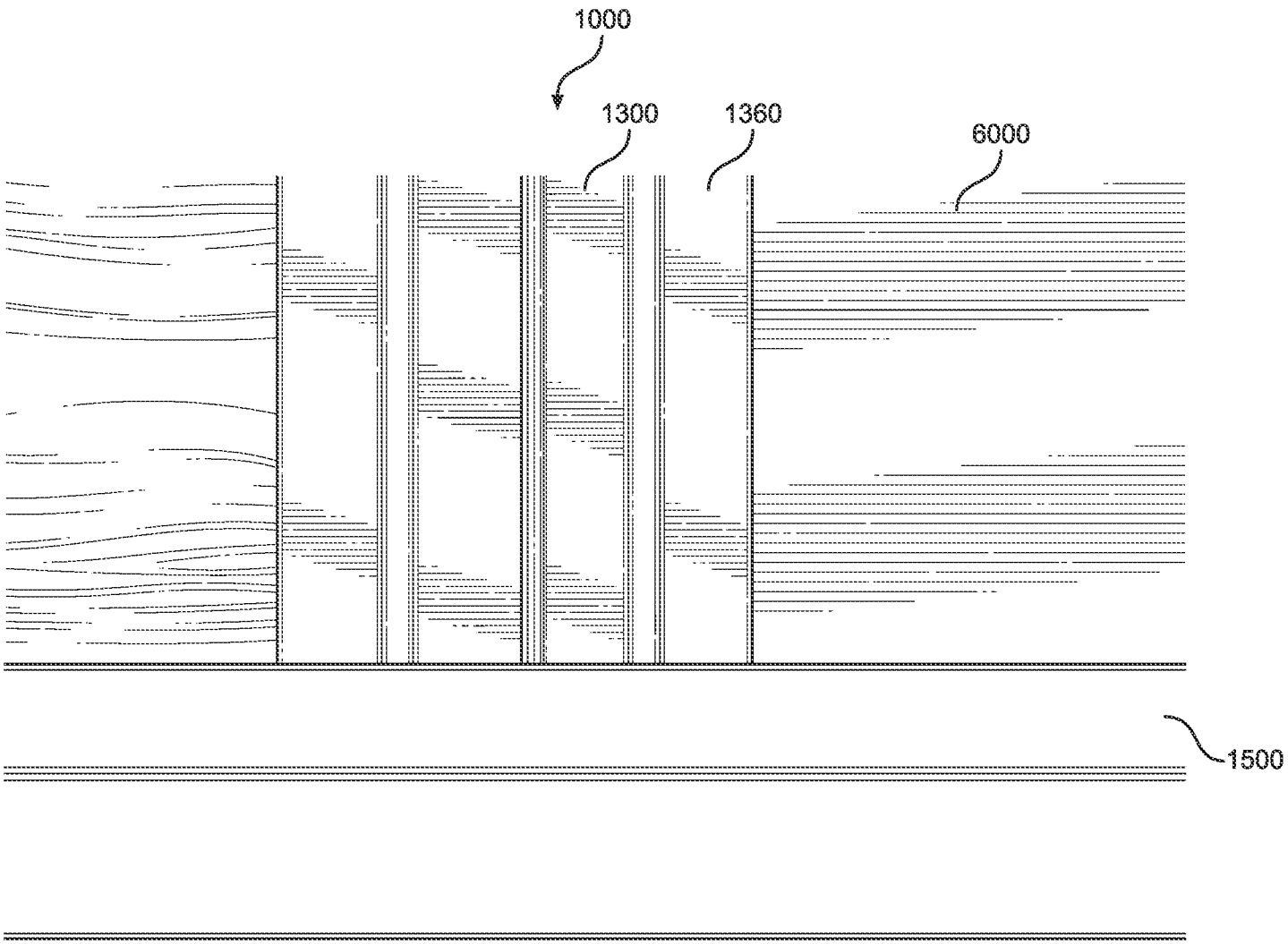
FIG. 5 shows a perspective view of an embodiment of the modular trim assembly installed.

Referring now to FIGS. 3-5, there is shown a perspective view of an embodiment of the modular trim assembly in an assembled configuration, a perspective view of an embodiment of the modular trim assembly in use, and a perspective view of an embodiment of the modular trim assembly installed, respectively. In the illustrated embodiment, the over trim section 1360 is substantially parallel to the under trim section 1210 in an assembled configuration and forms a gap 1400 therebetween. The gap 1400 is configured to receive an edge of siding or a window frame. In the assembled configuration, the rear wall 1120 of the base unit 1100 is disposed beneath the rear wall of the exterior unit 1300 and the first and second side units 1200 are inserted within the channel 1140 of the sidewalls 1130 of the base unit 1100. The rear wall 1120 of the base unit 1100 is mounted flush against the rear walls 1330 of the exterior members of the exterior unit 1300. In the illustrated embodiment, the exterior side of the exterior unit 1300 is exposed and forms the exterior of the modular trim assembly 1000.

In the illustrated embodiment, the exterior unit, the base unit and the side units are linear structures to allow the user to fit the needed length around a window or door. In the illustrated embodiment, the modular trim assembly is composed of a durable, but light weight material.

In some embodiments, the present invention comprises a method for assembling trim around siding of a building. In the illustrated embodiment, the method comprises providing a modular trim assembly having a base unit with a rear wall and a pair of parallel sidewalls extending from opposing lateral edges of the rear wall; a channel formed in each of the sidewalls extending a length of the base unit; a first L-shaped side unit and a second L-shaped side unit, wherein each side unit comprises an under trim section perpendicular to a mounting section; an exterior unit, wherein the exterior units comprises a rear wall and a pair of outer sidewalls extending from opposing lateral edges of the rear wall; and an over trim section extending from a distal edge of each of the pair of sidewalls of the exterior unit, wherein the over trim section is parallel to the under trim section in an assembled configuration and forms a gap therebetween. The base unit is fastened to an exterior wall and the mounting section of the first and second side units are inserted into the channels of the base unit. The exterior unit is mounted to the base unit such that the rear wall of the base unit is flush against the exterior unit. The siding is placed within the gap formed between the first side unit and the respective over trim section and the frame is placed within the gap formed between the second side unit and the respective over trim section. In this way, the edge of the siding is hidden by the trim sections and prevent water and vapor from easily passing to an underside of the siding.

The components of the modular trim assembly can be secured to the exterior wall with conventional fasteners such as a screw or nails. If needed, the modular trim assembly can be easily removed for reuse or repairs as needed by removing the fasteners and detaching the components from one another. In some embodiments, the modular trim assembly further comprises a cap member 1500 that is configured to extend horizontally between the vertical sides of the window or door and cover the ends of the base unit and exterior unit assembly.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular trim assembly, comprising:

a base unit having a base rear wall and a pair of parallel sidewalls extending from opposing lateral edges of the base rear wall;

a channel formed in each of the sidewalls extending a length of the base unit;

a first L-shaped side unit and a second L-shaped side unit, wherein each side unit comprises an under trim section perpendicular to a mounting section;

wherein the mounting section of each of the side units is configured to insert within the channels of the base unit;

an exterior unit, wherein the exterior units comprises a exterior unit rear wall and a pair of outer sidewalls extending from opposing lateral edges of the exterior rear wall;

an over trim section extends from a distal edge of each of the pair of sidewalls of the exterior unit, wherein the over trim section is parallel to the under trim section in an assembled configuration and forms a gap therebetween;

wherein the assembled configuration, the base rear wall is disposed beneath the exterior rear wall and the first and second side units are inserted within the channel of the sidewalls of the base unit;

wherein the gap is configured to receive siding or a window frame therebetween.

2. The modular trim assembly of claim 1, wherein the channel is open and comprises a U-shape.

3. The modular trim assembly of claim 1, wherein the exterior unit is formed from a first exterior member and a second exterior member removably securable to one another.

4. The modular trim assembly of claim 3, wherein the first and second exterior member each have a rear wall that form the rear wall of the exterior unit and an outer sidewall that form the pair of outer sidewalls of the exterior unit, wherein the first exterior member comprises a mounting member parallel to the sidewall thereof and the second exterior member comprises a second exterior channel extending from the rear wall thereof, the mounting member slidably securable to the second exterior channel.

5. The modular trim assembly of claim 4, wherein the over trim section is perpendicular to the mounting member and the U-shaped channel.

6. The modular trim assembly of claim 1, wherein the rear wall of the base unit is mounted flush against the rear wall of the exterior unit.

7. The modular trim assembly of claim 1, wherein an exterior side of the exterior unit is exposed and forms the exterior of the modular trim assembly.

8. The modular trim assembly of claim 1, wherein the base unit and the exterior unit comprise a same length and substantially a same width.

9. The modular trim assembly of claim 1, wherein the mounting section is configured to slide into the channel of the base unit.

10. A method for assembling trim around siding of a building, comprising;

providing a modular trim assembly comprising:

a base unit having a rear wall and a pair of parallel sidewalls extending from opposing lateral edges of the rear wall;

a channel formed in each of the sidewalls extending a length of the base unit;

a first L-shaped side unit and a second L-shaped side unit, wherein each side unit comprises an under trim section perpendicular to a mounting section;

an exterior unit, wherein the exterior units comprises a rear wall and a pair of outer sidewalls extending from opposing lateral edges of the rear wall;

an over trim section extending from a distal edge of each of the pair of sidewalls of the exterior unit, wherein the over trim section is parallel to the under trim section in an assembled configuration and forms a gap therebetween;

fastening the base unit to an exterior wall;

inserting the mounting section of the first and second side units into the channels of the base unit;

mounting the exterior unit to the base unit such that the rear wall of the base unit is flush against the exterior unit;

placing a siding within the gap formed between the first side unit and the respective over trim section;

placing a frame within the gap formed between the second side unit and the respective over trim section.

11. The method of claim 10, wherein the exterior unit is formed from a first exterior member and a second exterior member removably securable to one another.

12. The method trim assembly of claim 11, further comprising securing the first exterior member to the second exterior member.

* * * * *